United States Patent [19]

Ter Horst

[11] Patent Number: 4,776,149

[45] Date of Patent: Oct. 11, 1988

[54] DEVICE FOR PACKAGING A ROW OF COVERS AND THE MANUFACTURED PACKAGING

[75] Inventor: Gerrit H. F. Ter Horst, Schalkhaar, Netherlands

[73] Assignee: Thomassen & Drijver-Verblifa NV, Netherlands

[21] Appl. No.: 46,028

[22] Filed: May 4, 1987

[30] Foreign Application Priority Data

Jun. 3, 1986 [NL] Netherlands ..... 8601428

[51] Int. Cl.[4] ..... B65B 11/26

[52] U.S. Cl. ..... 53/229; 53/532

[58] Field of Search ..... 53/210, 227, 228, 229, 53/532

[56] References Cited

U.S. PATENT DOCUMENTS

| | | | |
|---|---|---|---|
| 1,757,079 | 5/1930 | English . | |
| 3,538,992 | 11/1970 | Chauhan | 53/532 X |
| 3,866,389 | 2/1975 | Elsner et al. | 53/229 X |
| 4,020,617 | 5/1977 | Sickinger | 53/229 |
| 4,209,960 | 7/1980 | Deutschlander et al. | 53/532 X |
| 4,651,500 | 3/1987 | Chaffey | 53/228 X |
| 4,669,248 | 6/1987 | Vrind et al. | 53/229 |

FOREIGN PATENT DOCUMENTS

| | | | |
|---|---|---|---|
| 0048105 | 3/1982 | European Pat. Off. | 53/210 |
| 447005 | 3/1968 | Switzerland . | |
| 1069649 | 5/1967 | United Kingdom . | |

*Primary Examiner*—James F. Coan
*Assistant Examiner*—Steven P. Weihrouch
*Attorney, Agent, or Firm*—John P. Snyder

[57] ABSTRACT

The invention relates to a device for packaging a row of covers placed coaxially of one another in a sheet of packaging material, comprising successively in the packaging direction: a feed station for the row of covers; a wrapping station for wrapping said row of covers in said sheet; a folding station for folding end wall and longitudinal fold edges of the sheet wrapped around the row of covers; and adhesive station for adhering fold edges to the packaging; and transport means for transporting the row of covers, which is characterized in that the folding station comprises gripping means gripping onto the wrapped packaging material from outside, which means hold the packaging material away from the row of covers during forming of the longitudinal fold.

Preferably the device comprises an adhesive support which can move axially reciprocating relative to a row of covers present in the folding/adhesive station and accommodated in a sheet of packaging material and which forms a support for the longitudinal fold edges to be adhered.

Tipping over of covers out of the row is prevented if further the adhesive support can move to a position P at an interval p from the row of covers, and that said adhesive support takes the form of a cylinder, the section of which corresponds substantially with that of said row of covers and which is provided with means for generating an underpressure in the space lying between said row of covers and said adhesive support, as a result of which a packaging constriction is formed.

The invention relates further to rows of covers packaged in packaging material according to the invention.

17 Claims, 16 Drawing Sheets

DEVICE FOR PACKAGING A ROW OF COVERS AND THE MANUFACTURED PACKAGING

The invention relates to a device of the type referred to in the preamble of claim 1 for packaging a row of covers positioned coaxially of one another. Such a device is described in the earlier U.S. application Ser. No. 867,569, filed 05/28/86 and now U.S. Pat. No. 4,669,248 of 06/02/87, commonly assigned herewith and claiming priority to Dutch patent application No. 85.01520.

Using this device it is possible to package a row of covers, whereby the packaging material is arranged tightly around the row. From this results a robust, form retaining packaging. A limitation of this device is the maximum permissible difference from one another of the row lengths of covers of at most 20 mm.

There exists at this time in some places a tradition of packaging rows of covers in sacks. And the covers are poured manually via the discharge opening into the feed of, for example, a closing machine.

The invention has for its object to provide a device for packaging a row of covers whereby the covers are packaged into a sack while the covers can easily be poured from the sack via the discharge opening. Packing in a sack affords the further advantage that due to a relatively greater length of the discharge opening flap there is greater tolerance for cover row lengths to be handled.

In order to provide a packaging to be emptied by pouring the device according to the invention is characterized in that the folding station comprises gripping means gripping onto the wrapped packaging material from outside, which means hold the packaging material away from the row of covers during forming of the longitudinal fold. In this way there results extra space in the paper that is wrapped and affixed around the row of covers.

Extra space can be provided in the paper in a simple manner if the gripping means grip the longitudinal fold edge which extends from the base plate and/or the locking plate, since these longitudinal fold edges extend freely from the base and/or locking plate and no opposing forces have to be overcome in the forming of the space.

A favourable and more compact construction results when the gripping means are accommodated in the base plate and/or locking plate.

A particularly advantageous embodiment of the gripping means results if gripping takes place by suction attachment to the packaging material, as a pressure difference is applied crosswise of the packaging material, and for this purpose the gripping means are connected via a line to a vacuum source and attach themselves by suction via at least one vacuum nozzle to the packaging material.

If the gripping means are accommodated in the base plate and/or locking plate and the gripping means comprise at least one vacuum nozzle it is recommended that the base plate and/or the locking plate comprises an underpressure chamber of which a wall facing toward the packaging material is provided with the vacuum nozzle.

It is to be recommended that the longitudinal fold edges located in the discharge opening flap are also adhered to each other so that the sack opening is adhered up to the discharge opening and discharge can take place without risk. In view of the fact that no covers are present over the length of the discharge opening flap in the wrapped packaging, it is strongly to be recommended that a support is temporarily arranged at that place such that the longitudinal fold edges to be adhered to each other can be pressed against it, ensuring glue adhesion. To this end the device is further characterized by an adhesive support which can move axially reciprocating relative to a row of covers present in the folding/adhesive station and accommodated in a sheet of packaging material and which forms a support for the longitudinal fold edges to be adhered.

In order to prevent tipping over in the packaging of at least the adjacent cover after removal of the adhesive support, thereby impeding the folding back and further handling of the discharge opening flap, it is recommended that a constriction in the packaging be formed in the proximity of this cover. Such a constriction can be effected if the adhesive support can move to a position P at an interval p from the row of covers, and if the adhesive support takes the form of a cylinder, the section of which corresponds substantially with that of the row of covers and is provided with means for generating an underpressure in the space lying between the row of covers and the adhesive support, as a result of which a packaging constriction is formed. In order to form a more permanent constriction in the packaging material it is recommended that the adhesive support can move from the position P to the position Q close to the end wall position of the row of covers. The movement of the adhesive support can be regulated with certainty if the adhesive support is provided with a sensor for setting the distances P and Q.

By forming the packaging constriction and making the movement of the adhesive support dependent on the length of the row of covers, the tolerance for row lengths to be handled is already increased. The tolerance can be increased still further if the folding means for folding and folding back of the discharge opening flap are located at a quite large interval beyond the end folding means for forming the sack bottom, and after forming of the sack bottom the virtually completed packaging is moved using a pusher element to the end folding unit for formation of the discharge opening flap. For this purpose the device is further characterized in that the folding station comprises:

a first end folding unit for forming a bottom fold;

a second end folding unit for forming a discharge opening fold; and a pusher element located between both end folding units which presses the packed row of covers onwards from the first to the second end folding unit. If the discharge opening flap has to be laid carefully against the packaging the second end folding unit further comprises guide members which guide the packaging on the constriction, which members extend transversely of the axial axis of the row of covers to be guided; and fold-back means for forming a folded back discharge opening flap.

As a result of the greater permitted tolerance in row length it has now become possible to form a row of covers not only by cutting off a determined length but also by counting off a pre-determined number. As a result of a difference in the thickness of basic materials and the shaping machine for the covers, particularly the height of the die which is dependent on duration of use, the height of a cover is variable and thereby also that of a row of covers consisting of a number that has been counted off. Because the device according to the invention permits a greater tolerance for row length, it is possible to handle counted off quantities of covers with this device, and to this end the device is further characterized in that the feed station comprises a counting unit for forming a row of covers consisting of a determined set number.

Finally the invention relates to a row of covers packaged with the device according to the invention which are accommodated in a sack-shaped packaging which is provided on one side with a closed bottom and on the other with a discharge opening for opening which is folded back and may be adhered to the packaging.

Mentioned and other characteristics of the device according to the invention will be further elucidated with reference to an embodiment of a device, this embodiment only being given by way of example.

In the drawing:

FIG. 1 shows a perspective, partly broken away view of the packaging device according to the invention;

FIGS. 2–6 each show a view of a section of the wrapping, folding and adhesive stations with the various stations in successive packaging positions;

Figure 16:
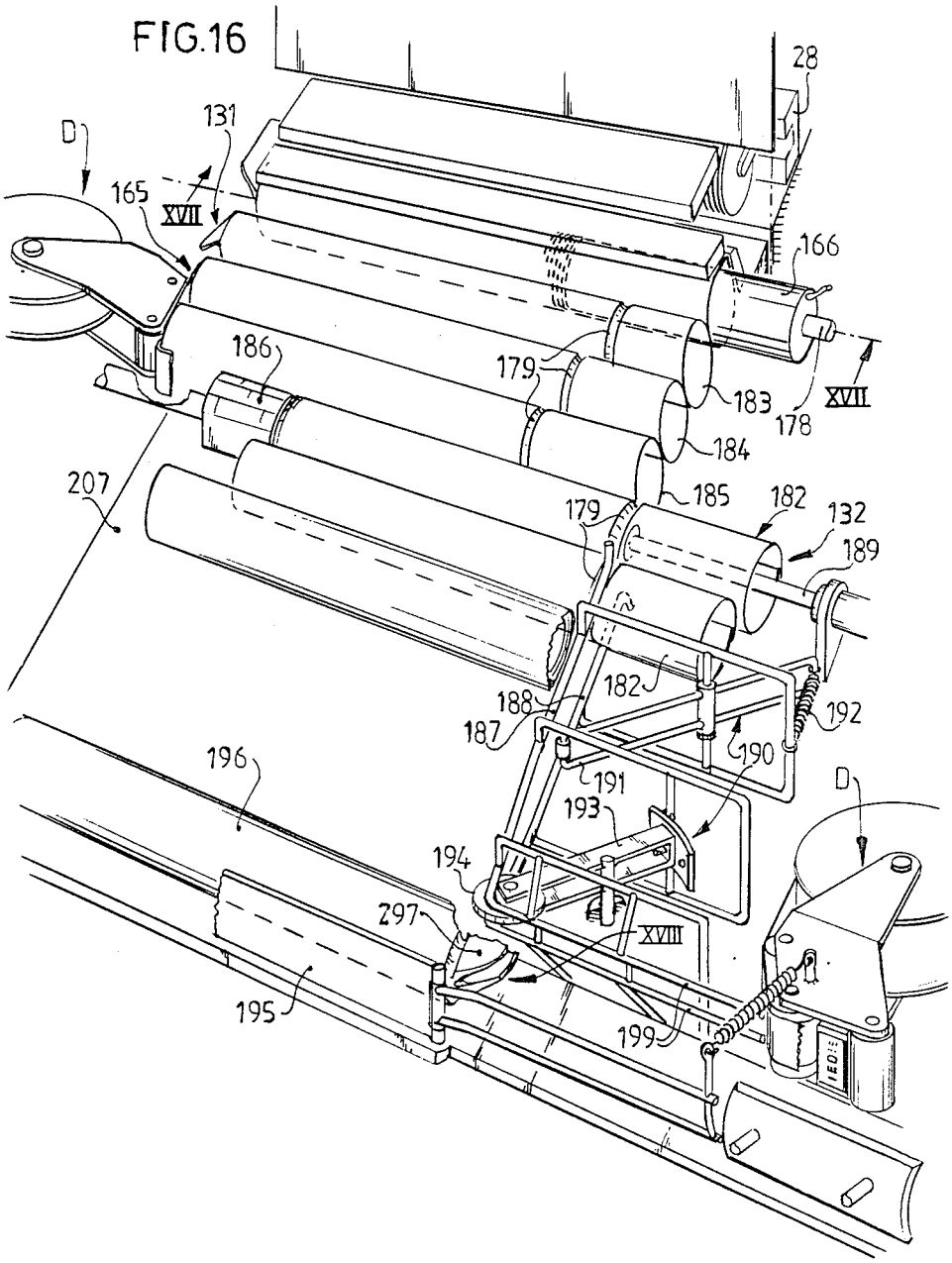
FIG. 16 shows a view as according to arrow XVI from FIG. 1.
Figure 17A:
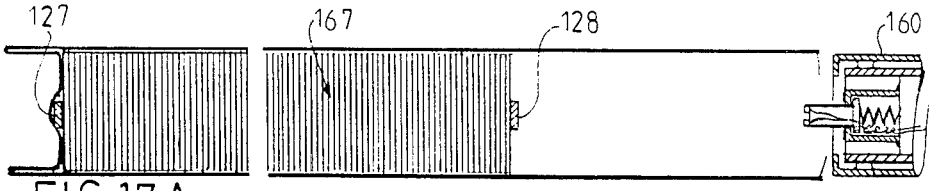
Figure 17B:
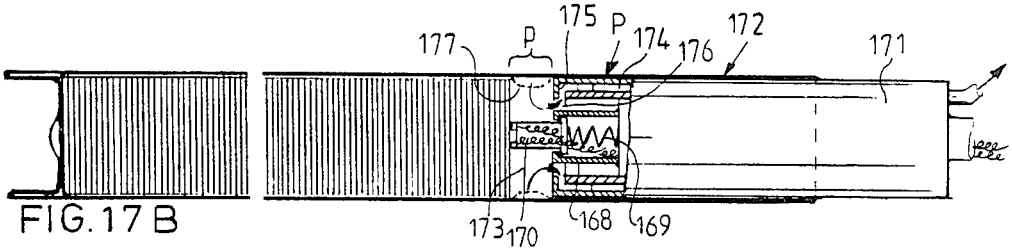
Figure 17C:
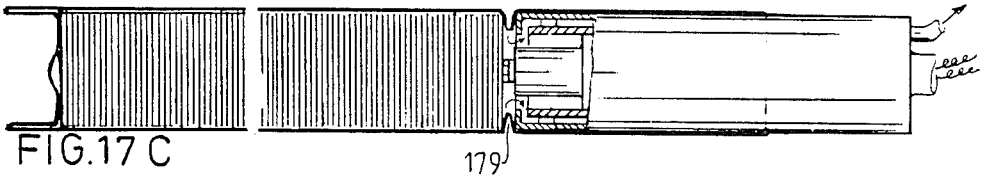
Figure 17D:
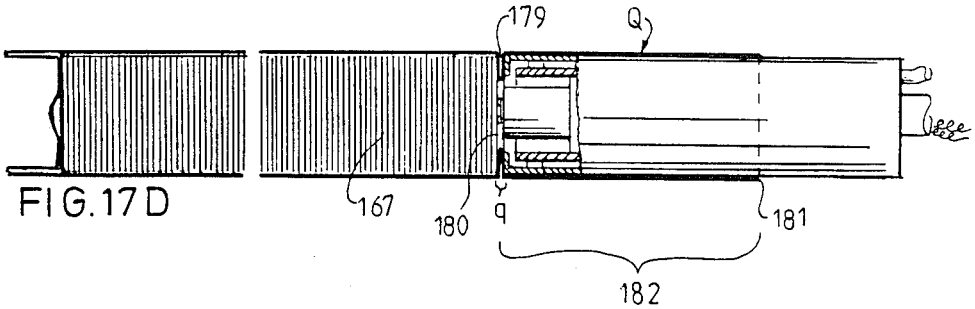
Figure 18:
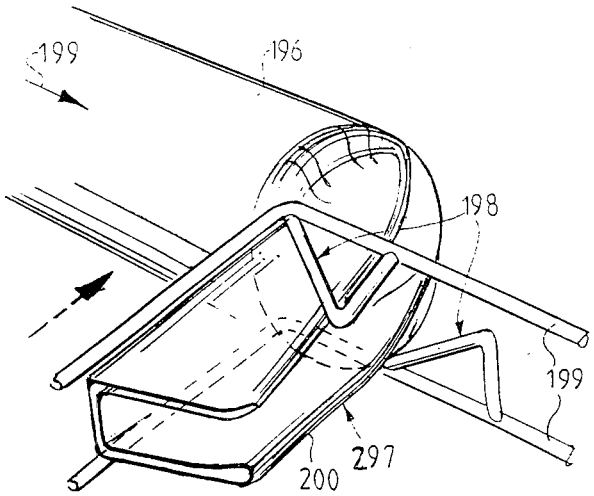
Figure 19:
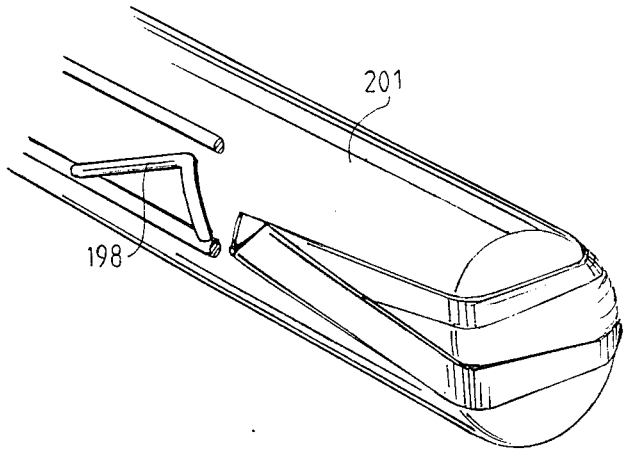
Figures 20, 21, 22:
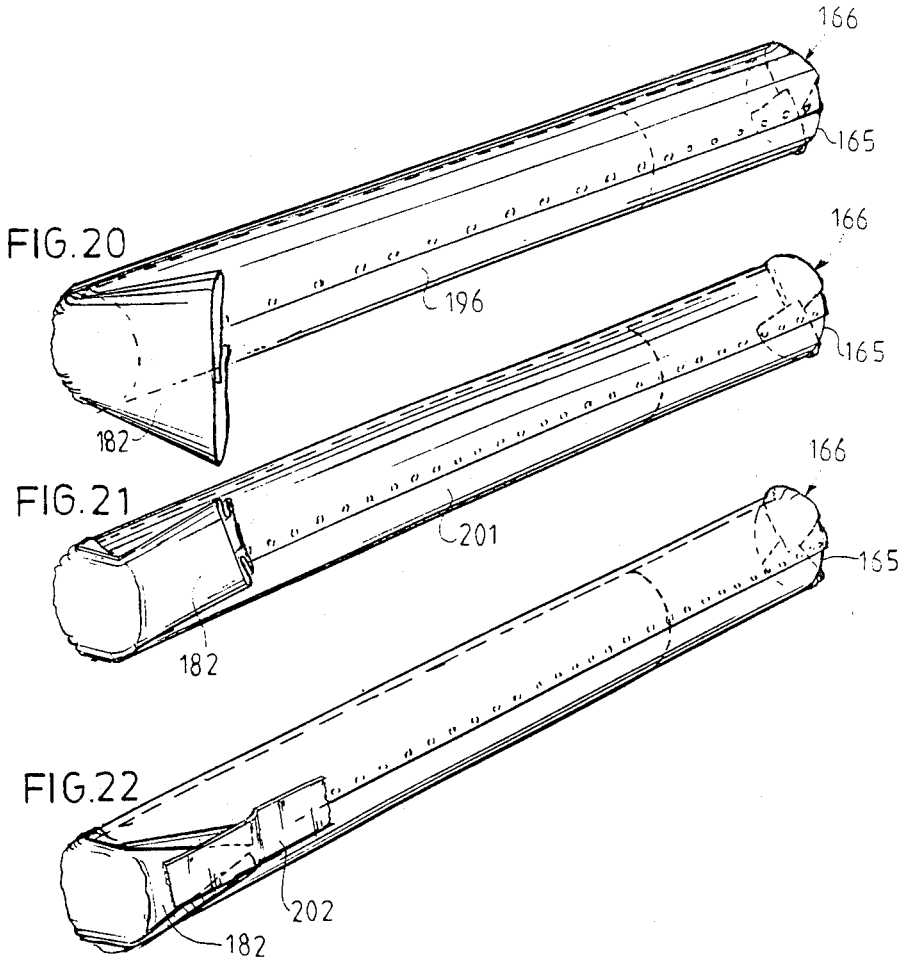

FIG. 17 A–D are sections along the line XVII—XVII from FIG. 16 with the adhesive support in different operative positions;

FIG. 18 shows a view according to the arrow XVIII from FIG. 16;

FIG. 19 is a view corresponding to FIG. 18 after passage of the second fold-back means; and FIG. 20–22 show respective packagings formed in various stages of the device according to the invention.

Figure 1:
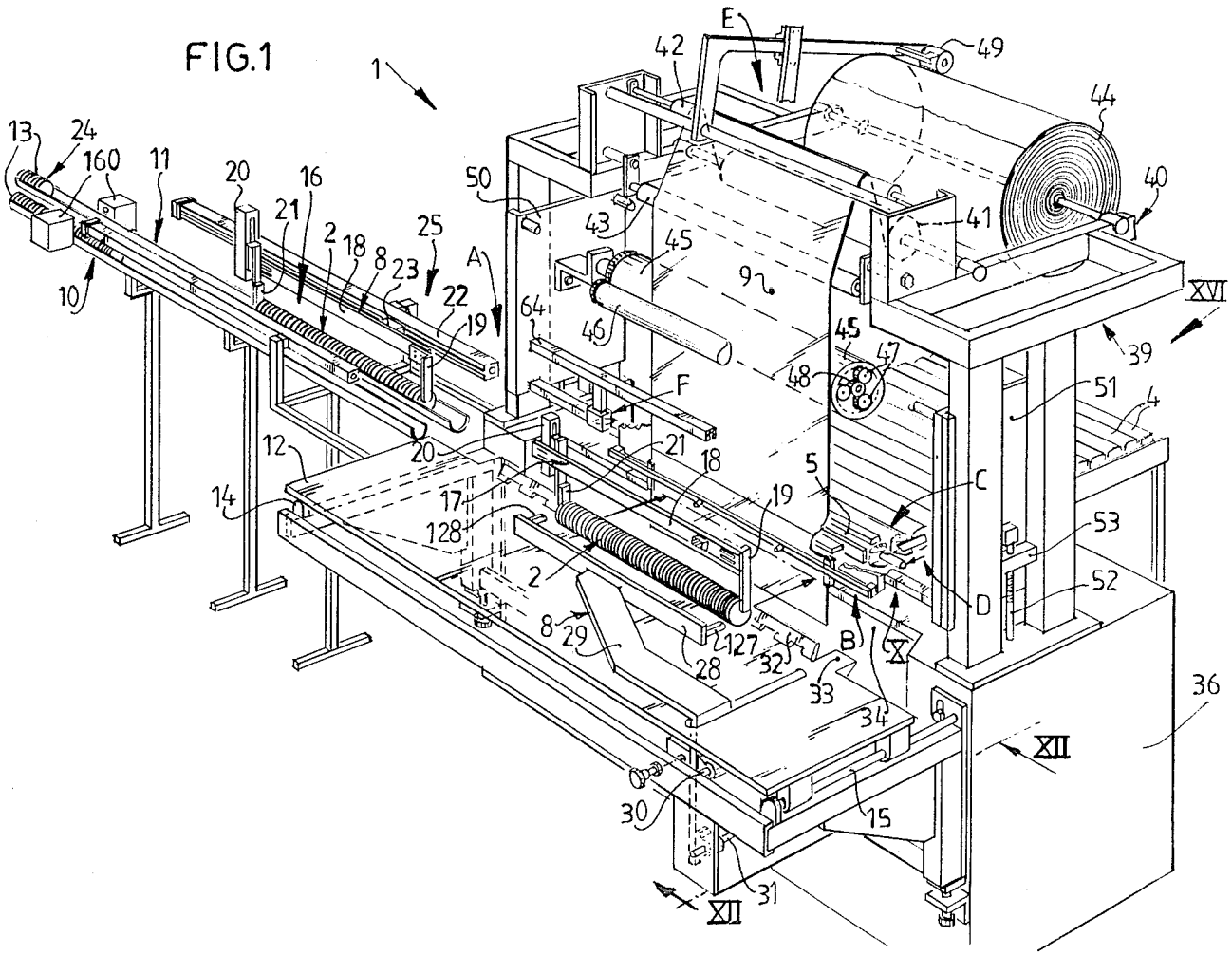
Figure 2:
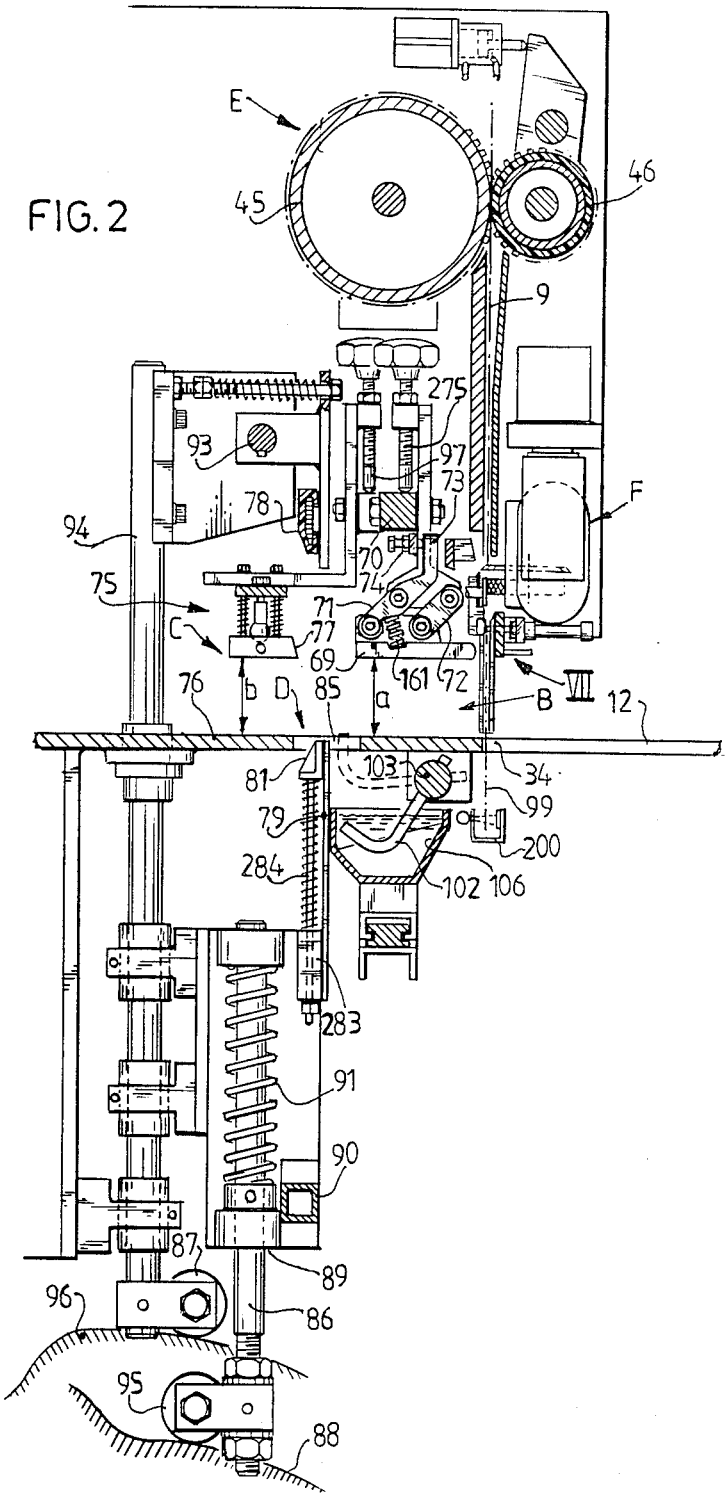
Figure 3:
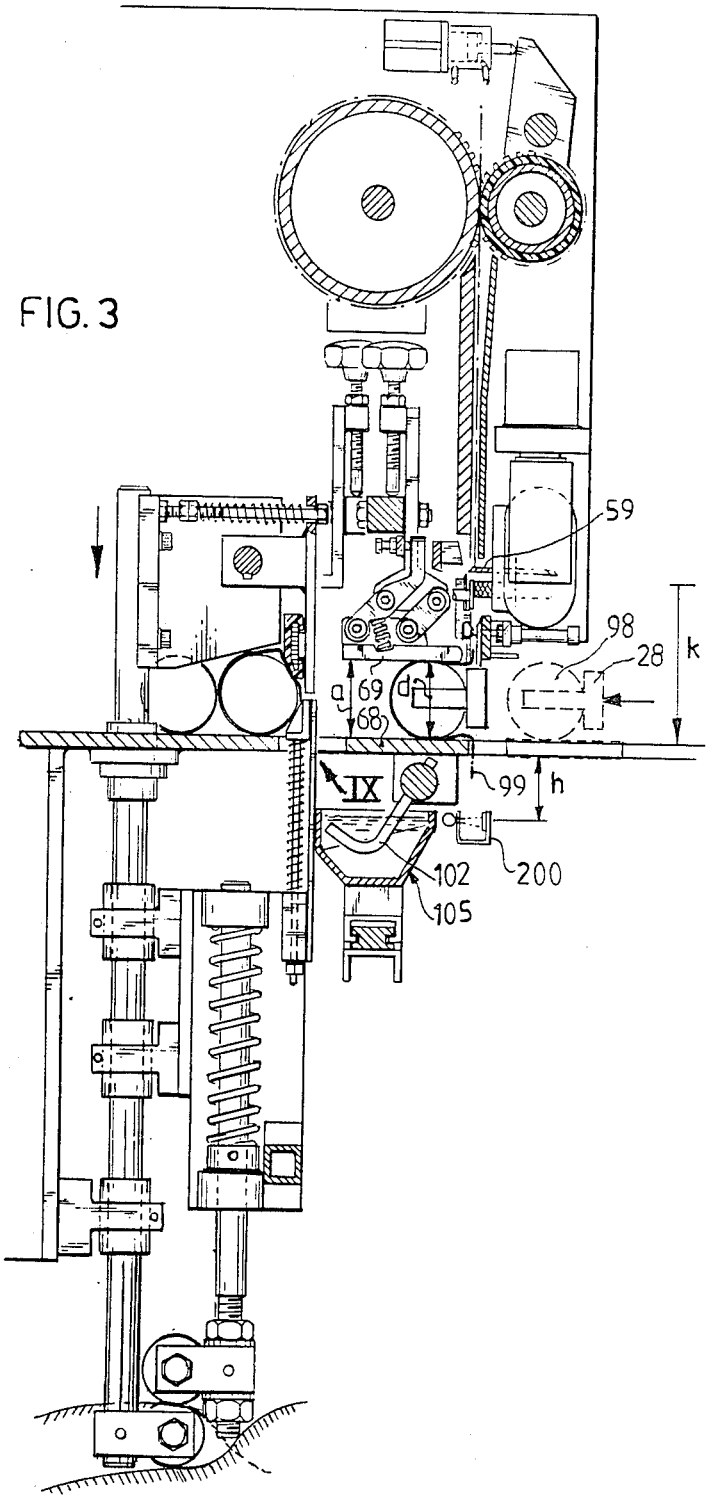

FIG. 1 shows in perspective the packaging device 1 in accordance with the invention for packaging a row 2 of covers 13 placed coaxially of one another in a sheet 3 of packaging material to form a sausage-like package 4.

The device 1 comprises successively in the packaging direction: a feed station A for the rows of covers 2; a wrapping station B for wrapping the row of covers 2 in sheet 3; a folding station C for folding the wrapped sheet 5; and an intermediate station D for adhering fold parts to the packaging. In addition device 1 comprise conveyor means 8 for transporting the row 2. Situated between feed station A and wrapping station B is also a supply station E for widths of packaging material 9. Finally there is a cutting unit F present for cutting packaging material 9 into sheet 3.

Feed station A is provided with two feed units 10 and 11 which have a trough form and are each connected upstream to a machine manufacturing elements 13. Each feed unit 10 and 11 leads to a feed table 12 which is guided in guides 14 and 15 and can slide under the influence of a pneumatic cylinder 216 between each of the two feed units 10 and 11 and wrapping station B.

Conveyor means 8 comprise for each feed unit 10 and 11 a conveyor unit 16 and 17 respectively. Each conveyor unit 16 and 17 comprises a guide strip 18 having a strip 19 firmly attached to it downstream and a cut-off memeber 21 located upstream which can be moved up and down using a cylinder 20. Guide strip 18 is firmly attached to a piston 23 guided in a cylinder 22.

Next to each trough-shaped feed unit 10, 11 is a known counting unit 160 which counts off the covers by means of light reflection on a cover portion and which after counting a pre-determined number separates this row 2 from the growing row 24, this row 2 then being enclosed between the strips 19 and 21 of the respective conveyor units 16 and 17. Conveyor unit 16 transports row 2 at a faster speed relative to the speed of growth of the row 24 to an intermedite station 25 directly at the outlet of each feed unit 10 and 11 or to a point in front of a pusher element 28. Regulating, detection, control and actuating means do not per se form part of the invention and are therefore not described further.

Figure 13:
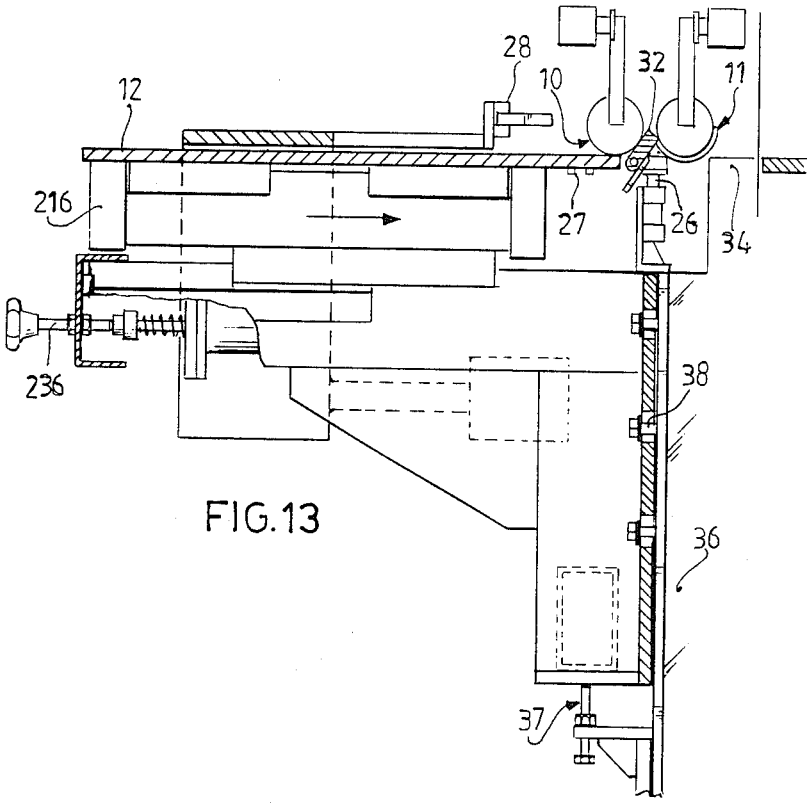
FIG. 13 is a section through the line XIII—XIII from FIG. 1.

After the feed table 12 has been carried to a point in front of the feed unit using cylinder 16 and has been positioned there relative to feed unit 10 using positioning pin 26, conveyor unit 17 transports the row 2 to a point in front of a pusher element 28 which can move reciprocally over the feed table 12 (see FIG. 13).

Pusher element 28 is guided via a hook-shaped arm 29 by means of guides 30 and 31 on the feed table 12. In this way the pusher element 28 moves when feed table 12 moves.

During transport of the row 2 in front of pusher element 28 the row is guided using a guide 32 arranged along the edge 33 adjoining wrapping station B. Guide 32 can tilt between a tilted position shown in FIG. 1 and 13 and a position whereby the guide lies in the plane of the feed table. In this latter position the guide partially bridges a slit 34 lying between feed station A and wrapping station B.

The movement of pusher element 28 away from wrapping station B is bounded by a buffer unit 35 with which the stroke of pusher element 28 is adjustable, also using adjustment bolt 236, subject for example to the diameter of the covers 13.

Feed table 12 together with its guiding is releasably attached to the base frame 36 of device 1. Using setting means 37 and 38 feed station A can be aligned relative to wrapping station B.

Supply unit 1 for widths of packaging material 9 comprises a tower 39 which is carried on the frame 36. Tower 39 comprises a seat 40 for rolls 41 and 44 of packaging material. The width 9 is guided over the roller 42 and roller 43, and then guided between a drum roller 45 and a co-operating pressure roller 46. Drum roller 45 is provided with an internally fitted motor which drives a shaft 48 coupled via toothed wheels 47 with drum 45. By guiding the width 9 over roller 42 the greatest possible amount of tension, for example warp tension, is removed from width 9.

Using a coding unit 49 a code is applied to width 9 and thereby to the sausage-like packaging 4. The code applied is for example a code for the device 1. The rollers 45 and 46 are attached for rotation to carriages 50 and 51 guided along tower 39, which carriages, using a spindle 52 screwed into a cross piece 53, are height adjustable in respect of feed table 12 and a work table 54 located in the same plane. Each carriage 50 and 51 is provided with a spindle 52.

Figure 7:
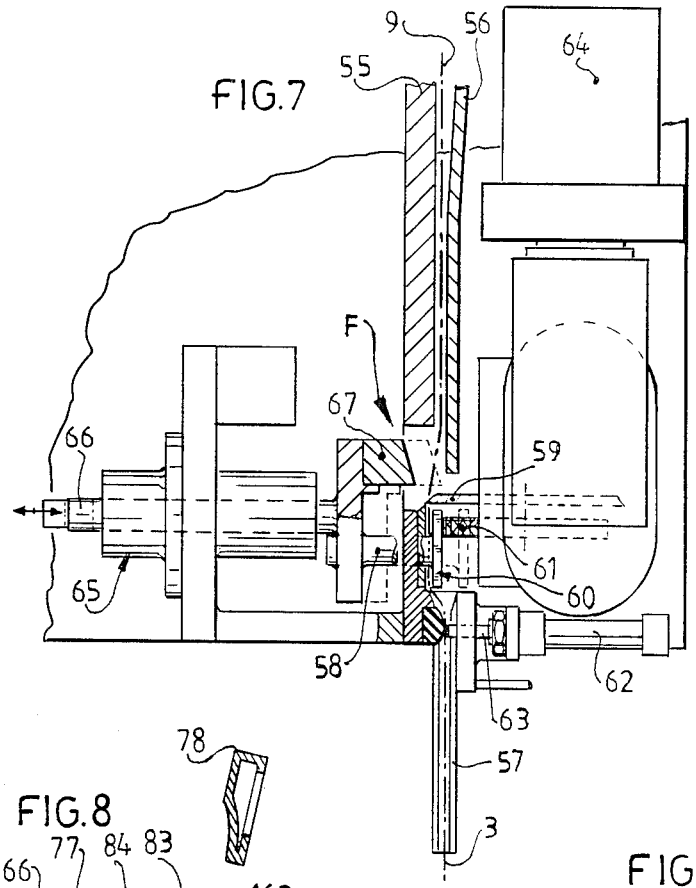
FIG. 7 is detail VII from FIG. 2 on a larger scale.

FIG. 7 shows in more detail the cutting unit F for cutting into a sheet 3 the width of packaging material 9 which is guided between plates 55 and 56 forming a letter box. The cut sheet 3 is guided at its longitudinal edges in "U"-shaped guide strips 57. The cutting unit consists of a stationary knife blade 58 extending over the whole breadth of the width 9 of packaging material and a disc-shaped knife 59 co-operating with it which can be displaced transversely over the width 9. During displacement knife 59 is driven for rotation by rollers 61 running over a paper pressure strip 60. Using punches 63 actuated by a pressure cylinder 62 the sheet is clamped in position after cutting. The rotary knife 59 is connected for displacement on a pressure cylinder 64 and moves between two positions situated on either side of width 9 (see FIG. 1) so that the paper pressure strip 60 can be displaced between the positions shown in FIG. 7 with full lines and dashed lines. A nose 67 mounted for sliding in the piece 65 by means of a rod 66 can be carried into the passage between plates 55 and 56, in order to lead the width 9 passing through cutting unit F such that the width goes between the stationary knife 58 and the paper pressure strip 60 and is guided downstream in the side guides 57.

The FIGS. 2–6, 8 and 9 show in more detail the wrapping station B, the folding station C and a part of the adhesive station D.

Wrapping station B comprises a wrapping base plate 68 aligned with feed table 12 and a wrapping plate 69 arranged at an interval a above base plate 68. Wrapping plate 69 is suspended while locked against tilting out of the horizontal position from a beam 70 by means of links 71 and 72 in parallelepiped orientation. Link 71 is provided with a nose 73 which co-operates with an adjustable stop 74. A lowest position of wrapping plate 69 is set in this way, and can if required be adjusted with the adjusting screw 275. Springs 161 force the wrapping plate 69 to its lowest position.

Folding station C comprises a longitudinal fold unit 75 with a folding base plate 76 and a locking plate 77 arranged for tilting at an interval b above base plate 76, and reciprocally co-operating folder blades 78 and 79. Folder blade 79, referred to as the lower folder 79, forms the fold edge 80 to be applied against the row 2 and is provided with a wedge-shaped pushing member 81 which is guided for sliding along the surface 82 of the lower folder 79 facing towards the row of covers 2 using a rod 84 mounted for sliding in the bearing 83. The lower folder can be moved through a slit 85 arranged in folding base plate 76 using a frame 86 which supports on and rolls over the curve 88 by means of a curve roller 87. In order to prevent damage to lower folder 79 if its path should be blocked, the lower folder is arranged on the lower folder frame 90 which is guided on rod 89, whereby a spring 91 continually forces frame 90 to its lowest position.

In a similar way the folder blade 78, referred to as upper folder 78, for forming the overlapping fold edge 92 is attached for pivoting on a shaft 93 on the frame 94 which via another curve roller 95 supports on and rolls over the curve 96. In view of the fact that the curves 88 and 96 are mounted for rotation on a common shaft the movement of both folder blades 78 and 79 is synchronized.

Using an adjusting pin 97 the interval b from locking plate 77 to folding base plate 76 can be adjusted.

The FIGS. 3–6 and 8 and 9 show the operation of the wrapping station B and the longitudinal fold unit 75.

Using the pusher element 28 a row 98 is pressed through a hanging sheet 99 and carried beneath the wrapping plate 69. Fingers 127 and 128 of pusher element 28 prevent tilting of the covers. The punches 63 are deactivated during this movement. The interval a is smaller than the diameter d of the elements 13, so that when row 98 is carried beneath plate 69 the sheet cannot displace relative to it. The length of the fold edge 80 is dependent on the height h between detector 200 and the underside of the wrapping base plate 68. The length of the fold edge 92 is dependent on the height k from the cutting blade 59 to the wrapping base plate 68, whereby the height k can be set with spindle 52 (FIG. 1).

Figure 4:
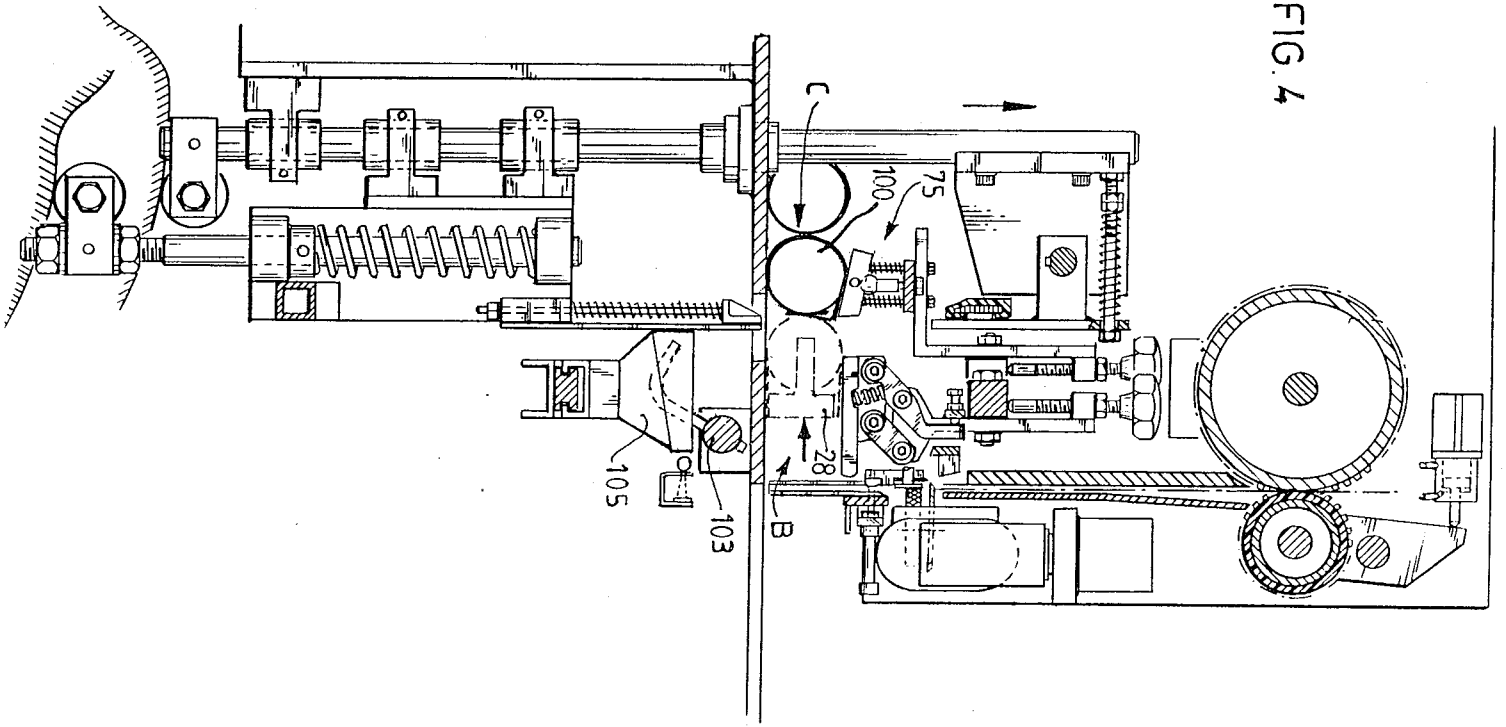

FIG. 4 shows clearly that the pusher element carries row 98 through wrapping station B into folding station C. As a result of wrapping, sheet 99 is arranged in a "U" shape around row 98.

The row 100 initially present in folding station C is handled at this location from the longitudinal fold unit 75 and the end folding unit 101.

Figure 5:
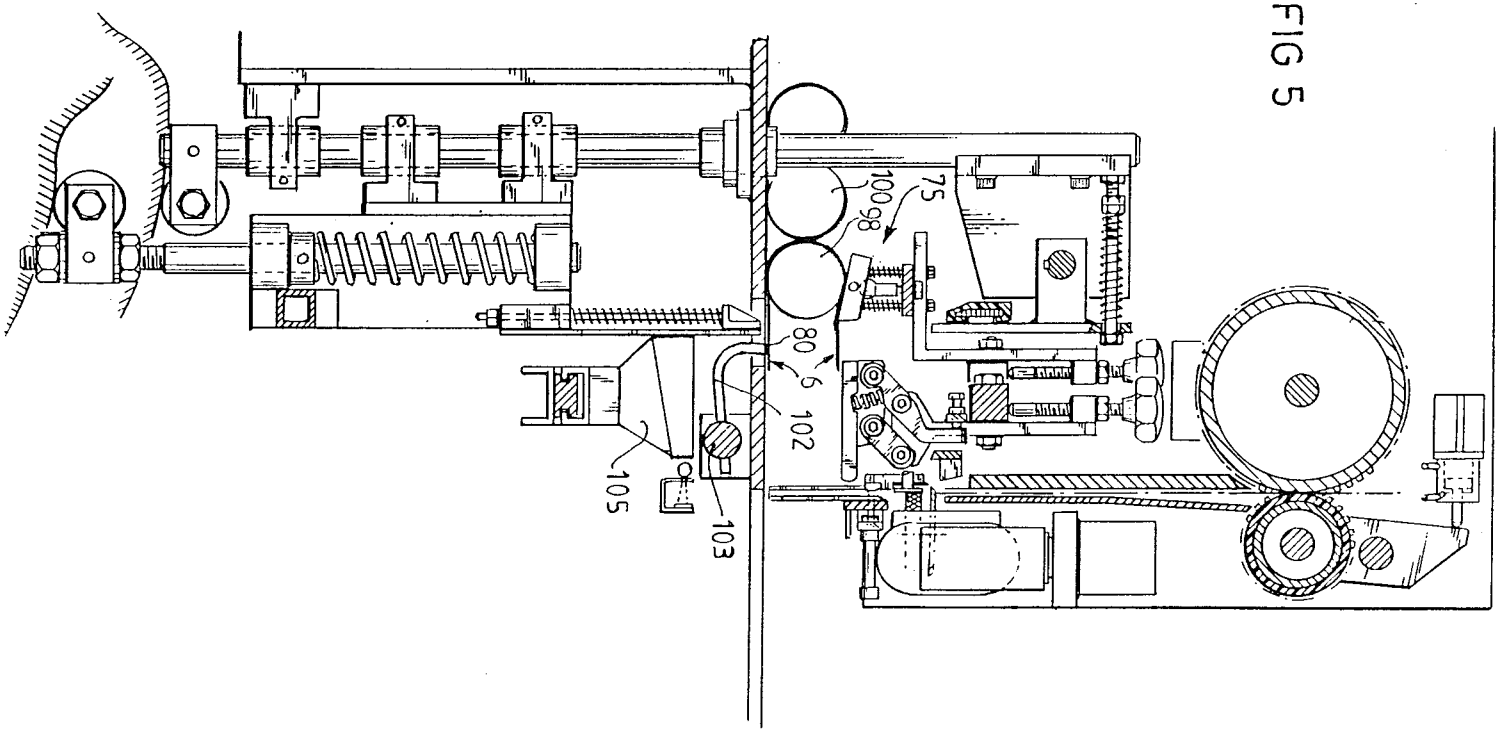
Figure 6:
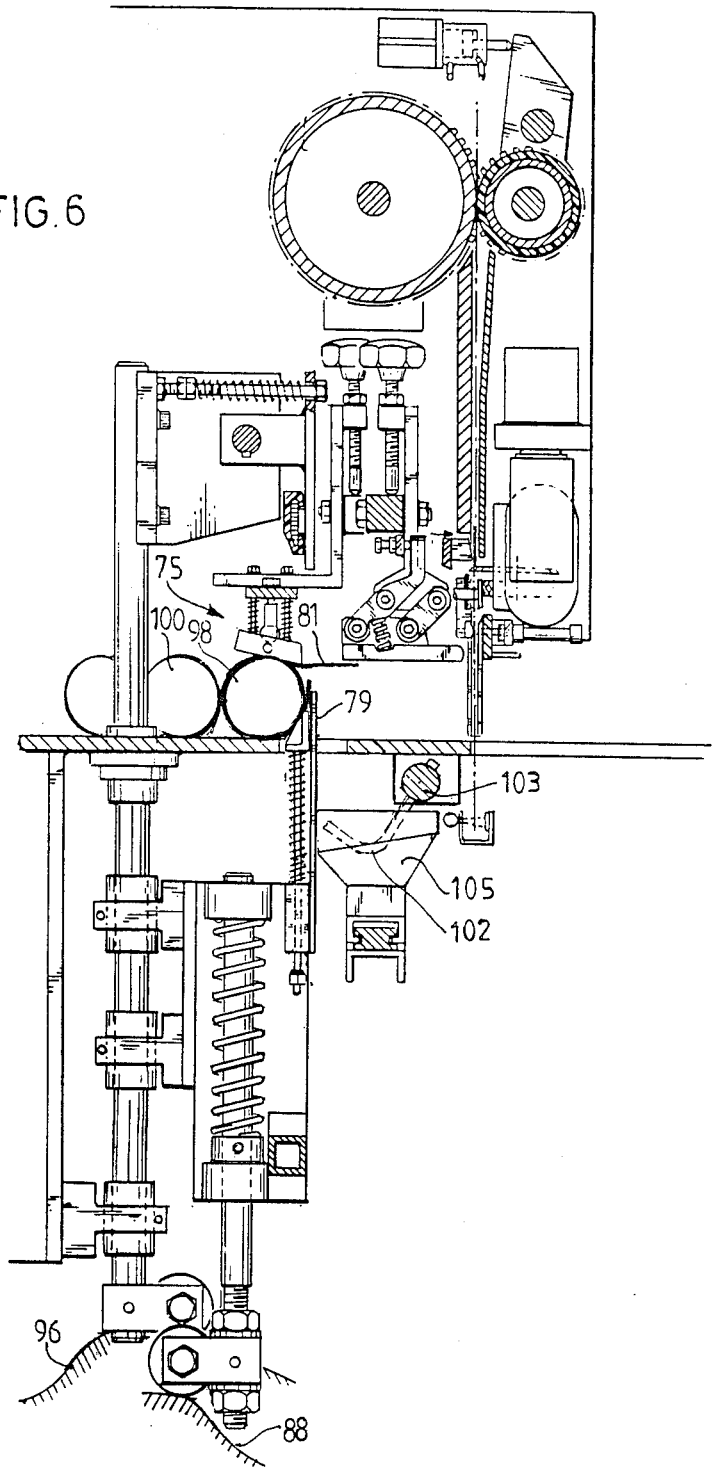

FIG. 5 shows the final position of row 98 in the longitudinal fold unit 75. It can clearly be seen that the tilted locking plate 77 prevents a displacement of row 98 against the packaging direction.

Figure 14:
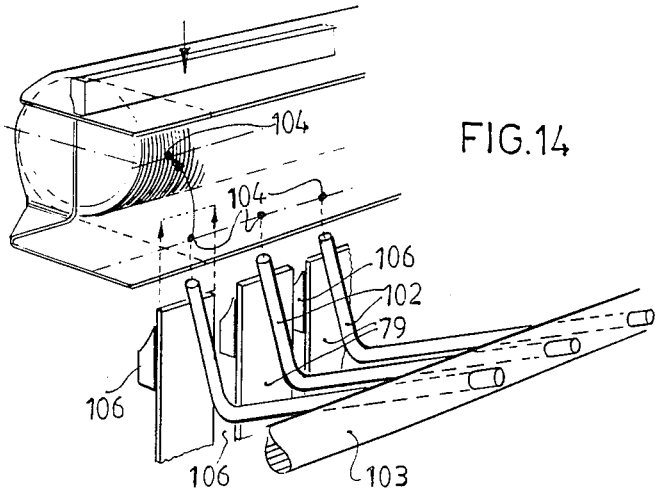
FIG. 14 is a perspective view as according to arrow XIV.

An adhesive rod 103 provided with adhesive fingers 102 is then activated (see FIG. 15) whereby the fold edge 80 is provided over its length with discrete adhesive points. The adhesive fingers 102 can move between a position indicated by dashed lines submerged in an adhesive container 105 and a position shown in full lines, in which adhesive fingers 102 touch fold edge 80. To make this movement possible the lower folder 79 is provided with a number of slits 106 as a result of which lower folder 79 does not come into conflict with adhesive fingers 102 (FIG. 14). Lower folder 79 can if required be constructed from a number of separate lower folder members.

Locking plate 77 is provided with gripping means 82 which grip sheet 99 on the fold edge 81 in the folding station. Gripping means 82 comprises an underpressure chamber 83 which is connected via a line 84 to a vacuum source (not shown). A wall 162 facing towards sheet 99 is provided with an elongate vacuum nozzle 163 which extends substantially over the whole length of the locking plate. It is likewise possible to use a large number of vacuum nozzles positioned at an interval from one another. Whatever the case, by applying a vacuum the fold edge 81 is sucked against wall 162 and held clear of row 98. Underpressure chamber 83 is coupled with the vacuum source as soon as row 98 reaches the position drawn in FIG. 8, and the vacuum is disconnected when row 98 leaves the folding station.

After the adhesive fingers 102 have swung away into the adhesive container 105 the curve shaft is actuated, whereby the curves 88 and 96 rotate. Lower folder 79 is first moved in upward direction, and fold edge 80 is applied against row 98. The pusher member 81 hereby pushes fold edge 80 in upward direction so that sheet 99 lies against the row because the locking plate 77 prevents a displacement of sheet 99 relative to row 98. Lower folder 79 displaces in upward direction to a point close to the adhesive points 104. Upper folder 78 is then displaced in downward direction, whereby the overlapping fold edge 92 is laid over fold edge 80 and they are pressed against each other at least at the height of the adhesive point 104. The upper folder 78 thereby assumes an inclining position, this being possible as a result of the tilting round shaft 93.

During folding of fold edge 81 over fold edge 80 using upper folder 78, a portion of sheet 99 remains sucked against wall 82, and as a result a space 164 is created, and the cross-sectional circumference of sheet 99 is greater than the circumference of the covers. In a similar way gripping means can be arranged at the point of the base plate 76, whereby the packaging is positioned around the row while leaving even more space.

Although the successive packaged rows 98 and 100 have line contact at the point of adhesive points 104, it can be recommended that the adhesive be set more rapidly and to this end the upper folder 78 can be provided with heating means (not shown), whereby the setting time of the adhesive can be reduced from 6–10 secs. to 2–3 secs., with the upper folder at a temperature of ca. 100° C.

Figure 9:
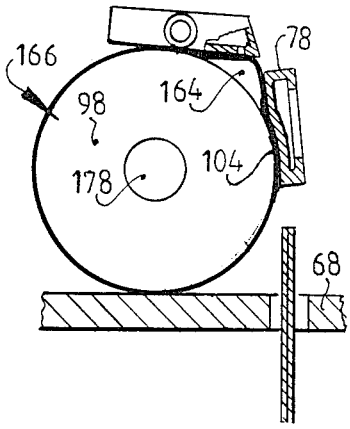
Figure 10:
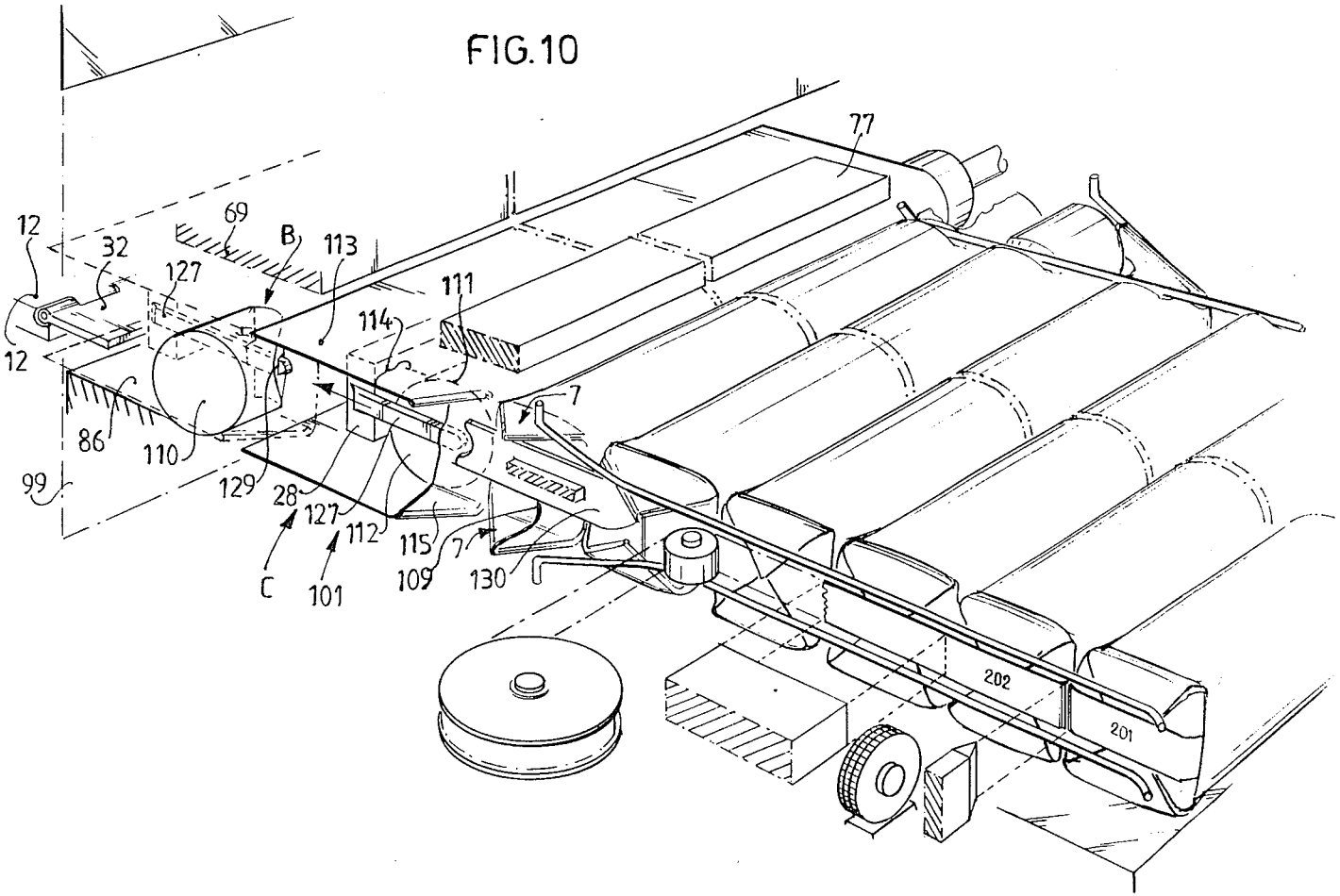
FIG. 10–12 show on a larger scale detail X from FIG. 1 with the folding station in various positions.
Figure 11:
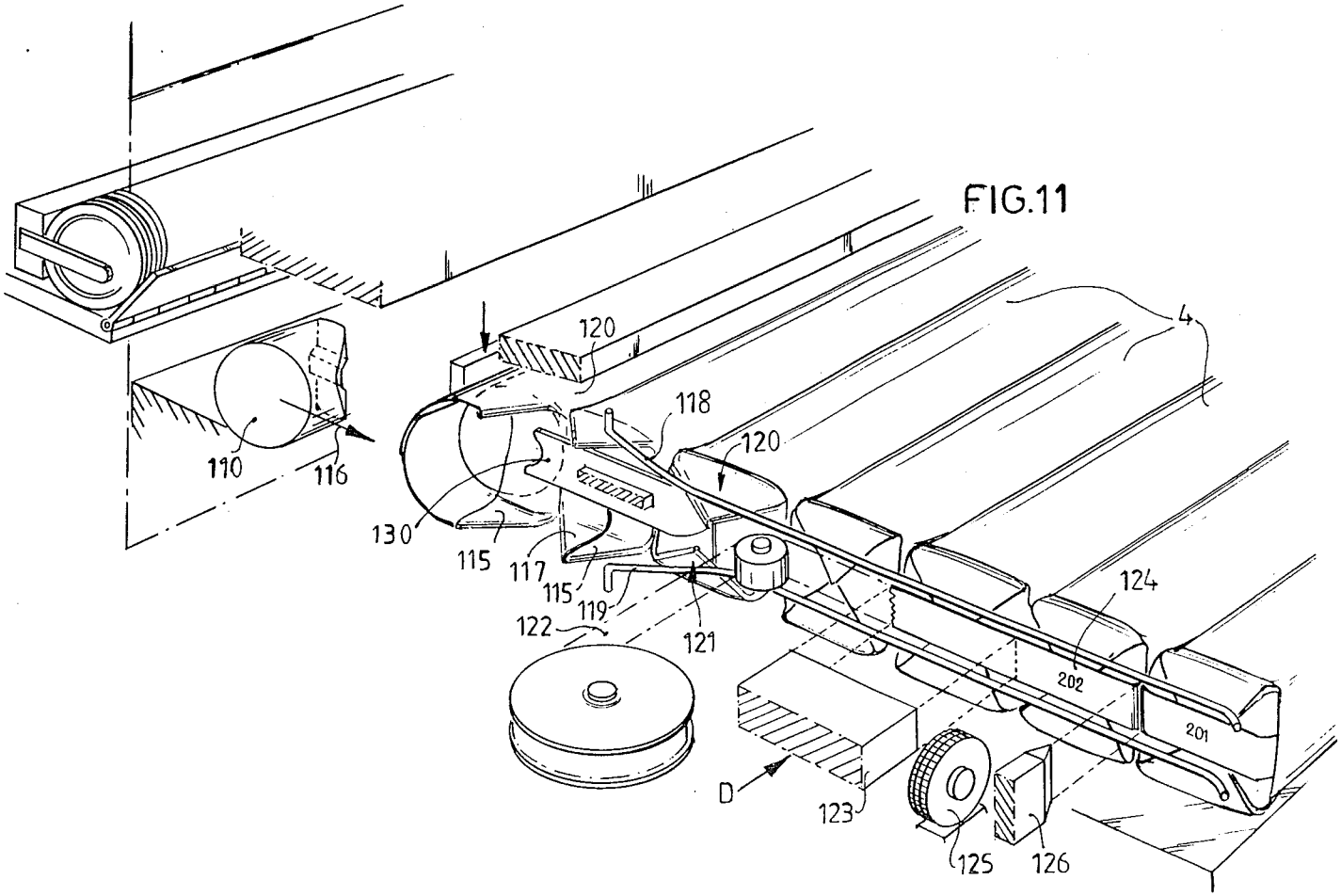
Figure 12:
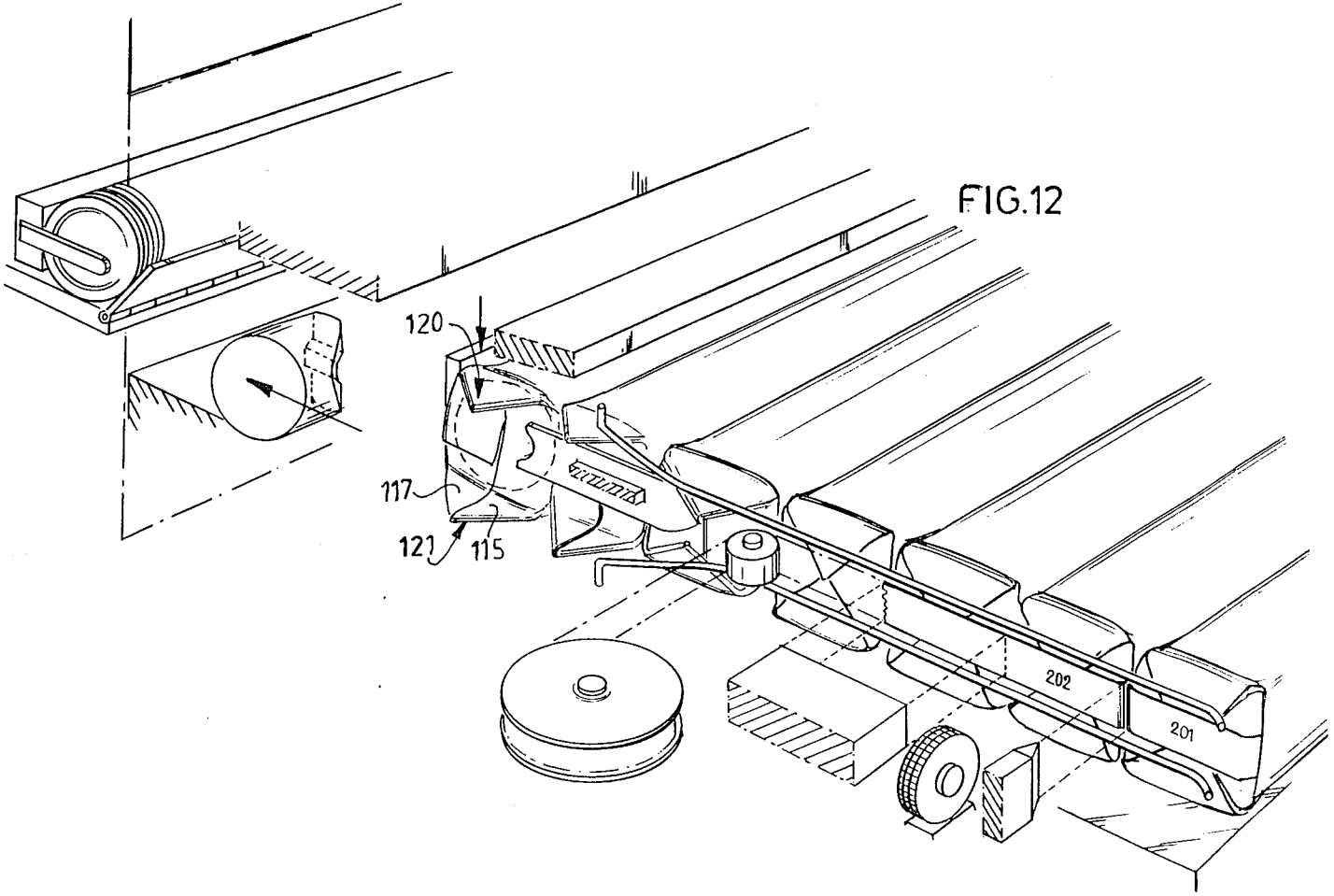

FIG. 10–12 show in more detail the end folding unit 101 of folding station C which is intended for formation of the bottom fold of the sack bottom 165. The end folding unit comprises two end folders 110 which can move relative to the end wall positions 111 of a wrapped row 112 of elements which arrive from wrapping station B at folding station C. At that moment sheet 113 is in a "U" shape, so that when end folder 110 is moved from the position shown with dashed lines to the position shown with full lines a bottom fold part 115 is folded out of the excess portion 114. After the pusher element is removed from folding station C and the longitudinal fold is formed using the folder blades (FIG. 8 and 9), the end folder 110 is displaced as according to arrow 116 (FIG. 11) onto the end wall position 111, whereby the other bottom fold part 117 is formed. Fingers 127 and 128 pass through the longitudinal slot 129 in the end folder. A guide strip 130 also prevents tilting of the covers.

Using guide rods 118 and 119 located downstream of the path of movement of end folder 116 the resulting bottom flaps 120 and 121 are brought towards each other and in this position provided with adhesive tape 122 in adhesive station D, so that the bottom 166 is formed. Using a pressure member 123 the adhesive tape 122 is pressed against the end wall position for better adhesion, and after application of a code 124 using a printing unit 125 the adhesive tape 122 between packagings 4 is cut by melting with a melting unit 126.

Printing unit 125 prints a code depending on whether the row 2 is supplied via feed unit 10 or feed unit 11. In this way is indicated from which cover forming machine the covers originate.

Figure 15:
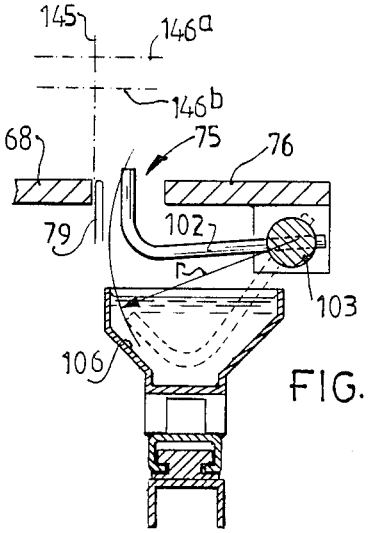
FIG. 15 is a section through the adhesive station.

Finally, FIG. 15 shows a number of setting planes in the device 1. The plane 145 which goes through the lower folder 109 determines the stroke of the pusher element 28 into the longitudinal fold unit 75.

The planes **146*a* and 146*b* go through the axial axis of a row of elements. Depending on the distance of these planes to the wrapping base plate 68 and the folding base plate 76 the radius r of each finger 102** is set so that the adhesive points are formed on the place where adjoining rows of folded sausage-like packagings are in line contact with one another. Moreover, soiling of the lower folder is prevented.

With the typical formed end fold, whereby the wrapping flaps 120 and 121 lie over and against the lower fold 109 and are adhered to the packaging, an end fold is created that withstands very well the axial outwardly directed forces of the elements accommodated under axial pressure in the packaging.

The adhesive tape 147 used in FIG. 16 is provided with two longitudinal edges 148 and 149 which are free of adhesive 150. An end wall position 151 can in this way be opened simply because these longitudinal edges 148 and 149 then serve as edges for gripping.

FIG. 16 and 17 show the place and function of the adhesive support 166. Prior to pusher element 28 being removed from wrapping station B and with it its fingers 127 and 128 from the end wall portions of the row 167, the adhesive support 166 is placed close to row 167, in order to replace finger 128, in a position P at a distance p. The function of finger 127 is taken over on one side by guide strip 130 and on the other side by the bottom fold part 115.

The adhesive support is provided with a sensor 170 which is guided in a bushing 168 and under spring bias of a spring 169, with which on the one hand the distance p can be adjusted and on the other a minimum distance q.

Figure 8:
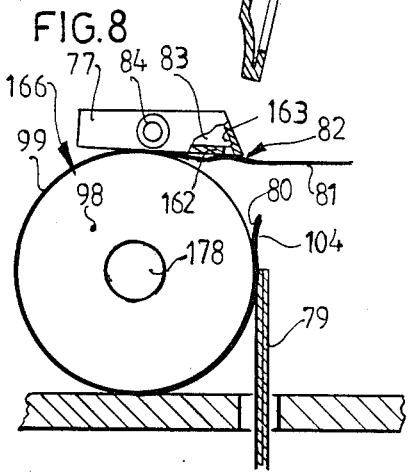
FIG. 8 and 9 show on a larger scale detail VIII and IX from respectively FIG. 6 and FIG. 3.

After the adhesive support 166 is positioned at a distance Q before row 167, wrapping as shown in FIG. 8 and 9 and adhering of the fold parts is performed. The outside surface 171 therefore serves hereby as supporting surface against which the fold parts to be adhered to each other are pressed using upper folder 78. A minimum requirement is that the adhesive support forms a support at the point of this contact face, but adhesive support 168 should preferably have a cross section which corresponds substantially to that of the row.

Prior to removal of the adhesive support 166 from the formed discharge opening 172, a vacuum is generated in the space 173 situated between the row 167 and adhesive support 166. The adhesive support is provided for this purpose with passages 174 connected to a vacuum source, which passages run out into openings 176 arranged in a front wall 175. Under the influence of the underpressure relative to atmospheric pressure the packaging material moves to a position as shown with dashed lines 177. While maintaining the vacuum the adhesive support 166 is then moved towards the row 167 to a minimal distance Q, whereby the packaging material, is creased such that an enduring packaging constriction 179 is formed. Adhesive support 166 is then removed and tilting of the covers out of row 167 is prevented by the now present packaging constriction 179 (see FIG. 17A–D). Because the movement of adhesive support 166 is only determined by the distances P and Q to the row, the constriction 179 is only formed conditional to the last cover 180 from the row 167 and conditional to the distance from this cover 180 to an edge 181 of the packaging material. In other words rows of covers with row lengths different from one another can therefore be wrapped, whereby only the length of the discharge opening fold 182 to be formed depends upon the length of the row 167 to be packaged.

This is shown in FIG. 16, in which a distance of the constriction 179 is different for packagings 183, 184 and 185. It will be further apparent that the formation of the constriction 179 takes place at the same time as the forming of the sack bottom 165. It is noted that in FIG. 16 is shown a variant of the adhesive station D shown in FIG. 10–12. The folding station comprises, apart from the first end folding unit 131 for forming the bottom fold 165 and the second end folding unit 132 for forming the discharge opening fold 182, a pusher element 186 located between both end folding units 131, 132, with which the packagings are aligned relative to the second end folding unit 132, namely so that the constriction 179 is guided by guide rods 187, 188 which are positioned transversely of the axial axis of each packaging. Using a sensor 189 co-operating with the pusher element 186 the constriction 179 is positioned accurately relative to the guide rods 187, 188.

Under the influence of the repetitive pushing movement of pusher element 28 the packagings are displaced between guide members 187 and 188 and thereby pass fold-back means 190, with which the discharge opening fold is laid carefully onto the discharge opening fold to be formed located upstream of it. The fold-back means 190 comprise a pivoting arm 191 which is forced against discharge opening fold 182 under the influence of a spring 192. The fold-back means further comprise a roller 194 mounted for rotation in a fork 193, so that the packaging 196 pressed against an end partition 195 acquires a form 197 of the discharge opening fold drawn in FIG. 16. This situation is shown from another visual angle as according to arrow XVIII in FIG. 18. Should no further process be carried out on packaging 196, it has the form as shown in FIG. 20.

It is in addition possible, using a pusher element (not shown), to displace packaging 196 in its axial direction in the direction indicated by arrow 197. During this movement the packaging passes second fold-back means 198 which are attached to guide rods 199 and with which the folded back flap 200 is folded together and laid against the packaging. This result is shown in FIG. 21. If packaging 201 is then guided past another adhesive station D, there occurs a result as shown in FIG. 22, whereby the flap is provided with a strip of adhesive tape 202.

If rows of covers with a constant row length are being packaged, it is possible to install the second end folding unit 132 directly opposite the first end folding unit 131 along packaging table 203.

Although described with two separate feed units the device according to the invention can also be provided with only one feed unit. All that is essential is that a sack shaped packaging is formed, out of which the rows of covers can easily be poured via the discharge opening.

I claim:

1. Device for packaging a row of covers placed coaxially of one another in a sheet of packaging material having longitudinal fold edges and end walls extending between the longitudinal fold edges, comprising successively in the packaging direction:

a feed station for the row of covers;

a wrapping station for wrapping said row of covers in said sheet;

a folding station for folding end wall and longitudinal fold edges of the sheet wrapped around the row of covers;

an adhesive station for adhering fold edges to the packaging; and conveyor means for transporting the row of covers; the folding station comprising gripping means gripping onto the wrapped packaging material from outside, which gripping means hold the packaging material away from the row of covers during formation of the longitudinal fold.

2. Device as claimed in claim 1 wherein the gripping means includes a base plate and a locking plate and.

3. Rows of covers packaged in packaging material as claimed in claim 1, comprising a sack-shaped packaging of packaging material which is provided with a bottom and a discharge opening having packaged therein the row of covers placed coaxially of one another which can be poured from said packaging via said discharge opening.

4. Device as claimed in claim 1, characterized in that the gripping means are connected via a line to a vacuum source and suck fast onto the packaging material via at least one vacuum nozzle.

5. Device as claimed in claim 4, characterized in that the base plate and/or locking plate comprises an underpressure chamber of which a wall facing towards the packaging material is provided with a vacuum nozzle.

6. Device as claimed in claim 1 characterized by an adhesive support which can move axially reciprocating relative to a row of covers present in the folding/adhesive station and accommodated in a sheet of packaging material and which forms a support for the longitudinal fold edges to be adhered.

7. Device as claimed in claim 6, characterized in that the adhesive support can move to a position P at an interval p from the row of covers, and that said adhesive support takes the form of a cylinder, the section of which corresponds substantially with that of said row of covers and which is provided with means for generating an underpressure in the space lying between said row of covers and said adhesive support, as a result of which a packaging constriction is formed.

8. Device as claimed in claim 7, characterized in that the adhesive support can be moved from the position P to a position Q close to the end wall position of the row of covers.

9. Device as claimed in claim 7 characterized in that the adhesive support is provided with a sensor for setting the distances P and Q.

10. Device as claimed in claim 1 characterized in that the folding station comprises:

a first end folding unit for forming a bottom fold;

a second end folding unit for forming a discharge opening fold; and a pusher element located between both end folding units which presses the packed row of covers onwards from the first to the second end folding unit.

11. Device as claimed in claim 10, characterized in that the second end folding unit comprises guide members guiding the packaging on the constriction, which members extend transversely of the axial axis of the row of covers to be guided; and fold-back means for forming a folded back discharge opening flap.

12. Device as claimed in claim 11, characterized in that the second end folding unit further comprises a pusher element which subsequent to the guide means transports the packaging in a direction transversely of the folded back flap past second fold-back means such that the discharge opening flap lies against said packaging.

13. Device as claimed in claim 1 characterized in that the feed station comprises a counting unit for forming a row of covers consisting of a determined set number.

14. Apparatus for packaging a compact row of lids in a loosely enveloping wrap of packaging material having end portions maintaining the compact integrity of the row of lids, which comprises the combination of means engaging lids of opposite ends of a row of lids for urging the lids into a compact row of lids while translating the compact row of lids relative to a sheet of wrapping material wider than the length of the row of lids and of a length greater than the circumference of the lids, means responsive to the translation for establishing the sheet of wrapping material in circumferential envelopment of the row of lids means while holding a strip of the packaging material away from the lids and for overlapping and joining the end edges of the sheet while the row of lids and the means engaging opposite end of the row of lids are relatively withdrawn from engagement with each other, and means for forming the end portions of the loosely enveloping packaging material against the opposite ends of the loosely enveloped compact row of lids.

15. Apparatus for packaging a row of lids in a loosely enveloping wrap of packaging material having end portions maintaining the integrity of the row of lids, which comprises the combination of means for relatively translating a row of lids and a sheet of wrapping material wider than the length of the row of lids and having end edges separated by a distance greater than the circumference of the lids, means for urging the sheet of wrapping material against substantially opposite sides of the row of lids while maintaining the sheet in only partially enveloping relation around the row of lids so that the end edges of the sheet are spaced apart, means for completing envelopment of the row of lids by the sheet while overlapping and joining the end edges of the sheet so as loosely to envelop the row of lids without complete circumferential contact therewith and to leave ends of the loosely enveloping packaging material at the opposite ends of the row of lids, and means for forming the end portions of the loosely enveloping packaging material against the opposite ends of the loosely enveloped row of lids.

16. Apparatus as defined in claim 15 wherein the means for urging the sheet of wrapping material against substantially opposite sides of the row of lids includes opposed surfaces spaced apart a lesser distance than the diameter of the lids and in which one of the surfaces is yieldable with respect to the other to accommodate the diameter of the lids.

17. Apparatus as defined in claim 16 wherein one of the surfaces is rockable.

* * * * *